US005306017A

United States Patent [19]

Huston

[11] Patent Number: 5,306,017

[45] Date of Patent: Apr. 26, 1994

[54] CIVIL WAR CHESS

[75] Inventor: James A. Huston, Lynchburg, Va.

[73] Assignee: Huston & Huston, Escondido, Calif.

[21] Appl. No.: 961,072

[22] Filed: Oct. 14, 1992

[51] Int. Cl.[5] ..... A63F 3/02

[52] U.S. Cl. ..... 273/261

[58] Field of Search ..... 273/255, 260, 261, 262

[56] References Cited

U.S. PATENT DOCUMENTS

| | | | |
|---|---|---|---|
| 511,773 | 1/1894 | Higgins | 273/261 |
| 1,207,466 | 12/1916 | Baines | 273/261 |
| 1,303,874 | 5/1919 | Fortune | 273/261 |
| 2,310,686 | 2/1943 | Freer | 273/255 |
| 2,703,713 | 3/1955 | Moyer | 273/262 |
| 3,843,130 | 10/1974 | Whitney | 273/261 |
| 4,688,802 | 8/1987 | Sandifer | 273/261 |
| 4,696,478 | 9/1987 | Farrell | 273/261 |

OTHER PUBLICATIONS

"Grand Chess", *Games Magazine*, Jan. 1987, p. 44.

*Primary Examiner*—William Stoll

*Attorney, Agent, or Firm*—Stan Jones

[57] ABSTRACT

The invention is a game of tactics and strategy, played on a special ten-square by ten-square checkered board of 100 alternately colored squares, with twenty pieces likened to figures of the American Civil War, on each of two opposing sides. Twenty Civil War playing pieces are alloted to each opposing player. While many of those pieces have traditional chess-type playing moves and capture strategy, some of the pieces, such as a gunboat on each side, have particularly unique moves that have no parallel in conventional chess. For example, a gunboat may not enter a thirty-six square restricted zone located at the interior of the board. A gunboat may, however, capture pieces within this restricted zone. Players, including the President, may board the gunboat, and with the President aboard the gunboat's moveability is the combination of the gunboat and the President's normal moves. With other players aboard, the gunboat's moves are simply its own; and, thus, the boarded gunboat does not have a combination of movement as it does when the President is aboard.

18 Claims, 2 Drawing Sheets

CIVIL WAR CHESS

TECHNICAL FIELD

The techical field of this invention relates to entertainment, tactics and strategy; and, more particularly, relates to a board game for a pair of opposing players who manipulate movable board pieces in a manner somewhat similar to opponents playing a conventional game of Chess. The improved board game, in comparison to chess, is characterized by an enlarged playing board having a piece-restricted playing zone thereon. Moreover, one type of playing piece not only has a limited space for movement but it has extraordinary flexibility for moving, strategy and capturing an opponent's pieces within the restricted zone.

BACKGROUND ART

The invention broadly relates to a board game of the checker or chess type in that two opposing players move their playing pieces in accordance with prescribed rules in an effort to outwit the opponent's strategy and moves. Of these two examples, the invention most closely resembles the conventional game of chess in piece movement and capture strategy.

A conventional chess game is played on a chessboard, identical to a checkerboard, with thirty-two pieces, one set of sixteen-white, and one set of sixteen-black, for each of two opposing players. The conventional board includes sixty-four squares of two alternating colors, usually white and black or red and black. The playing pieces are ranked with each rank being allowed certain moving privileges in varying patterns along the squares of the playing board.

One player each is situated across from the opposing player on each of two opposing sides of the chessboard. These two players, one for each side, face each other across the board, and each player has his own set of playing pieces that are initially arranged in a predetermined order on that player's side of the playing board. The object of the game is to maneuver one's men and pieces, according to prescribed rules, in such a way as to put the most highly-ranked piece, the opponent's king, in a condition of "checkmate." Checkmate is a situation in which that king is threatened with capture and cannot move out of vulnerability in any direction.

In an effort to promote additional glamour underlying the chess game, some known chess sets have substituted the figures of well known generals, such as Mr. Lee and Mr. Grant, for the conventional queen playing pieces. The traditional rules of play, however, have not been changed and conventional rules and playing surface size are employed.

Along with the wide appeal of chess, it is now also popular for computers to play a chess game, with the computer itself acting as one opponent. In computer chess, a computer has been programmed beforehand to play the many conventional moves based upon a data analysis of both of the opponent's moves in a conventional chess match. Although certainly powerful as far as data processing goes, a computer is not particularly adept at long range decision making. In other words, the computer program must have the data available in the program if it is to outwit the human player.

Even with the advent of so-called artificial intelligence, the long range decision making of a human being will generally defeat the computer in conventional chess games. This invention, however, adds several additional new dimensions that a computer will most likely not be capable of accommodating. For example, the invention: (1) expands the size of the chess playing field; (2) adds new types of moves for the playing pieces in that one of the playing pieces can suddenly "board" another (a gunboat playing piece) under prescribed conditions; (3) restricts some pieces from movement within certain board-restricted zones, and (4) adds a "boarding" feature for a player's President that provides, while boarded, a combination of the move options into that of both the president and the gunboat.

In short, the complexity of the new chess game will be increased dramatically by these new features, thus adding more enjoyment to the game for opponents. The "boarding" move will make computer chess with the new improved game more complex, tactically, due to the player's decision making involved in electing when and, whether or not, to board any given piece.

OBJECTS OF THE INVENTION

It is an object of this invention to increase the size of the playing board and the number of pieces per player, and thus advance the tactical complexity of a conventional chess game.

It is an object of this invention to provide a new and improved method of playing a chess game of enhanced complexity based upon an increase in playing board size and the number of playing pieces with newly added pieces and restrictions in playing space for a particular style of piece.

It is another object of this invention to add a restricted zone to a playing board of increased size so that at least one particular playing piece cannot enter that zone. The prohibited piece may, however, capture opponent's pieces from within the restricted zone in accordance with predetermined playing rules for zone-restricted playing piece(s).

It is still another object of the invention to use Civil War figures to represent the playing pieces in order to increase the realism and enjoyment of the game.

It is yet another object of this invention to provide playing pieces with unique moving capability on the playing board surface in order to make capturing another player's pieces a more tactical and logistical challenge.

It is still another object of this invention to provide the capture of an opponents playing pieces from within a restricted zone by an opposing player's piece which is allowed proscribed movement only outside the restricted zone.

It is still another object of this invention to provide a totally new move whereby each player has the option, under certain stated conditions, to "board" one piece with the restricted-zone piece. Once "boarded" both of the pieces are excluded from entry into the restricted zone.

It is still a further object of this invention to provide a totally new event when a player's President "boards". In that event the boarded piece (a gunboat) has enhanced flexibility of movement in that the "boarded" pair of pieces is then capable of a combined movement in accordance with the individual movement possibilities for both the President and/or the gunboat.

DISCLOSURE OF THE INVENTION

The invention of Civil War Chess is a game of tactics and strategy, played on a special checkered board of increased size, with twenty pieces likened to figures of the American Civil War, on each of two opposing sides. Two players, one for each side, face each other across the board. The object of the game is to maneuver one's men and pieces, according to prescribed rules, in such a way as to put the opponent's President in a condition of "checkmate," that is, a situation in which he is threatened with capture and cannot move out of vulnerability in any direction.

Of the twenty Civil War playing pieces allotted to each opposing player, the majority have conventional chess-type playing moves and capture strategy which directly correspond to the traditional chess pieces, moves and capture strategy. In this patent application, these common sixteen piece-identifications together with their traditional moves and capture strategy, are referred to simply as a direct equivalence to traditional chess. That is to say, that the invention relies to a large degree upon a direct correspondence between the Civil War pieces and their counterpart pieces as is well known in traditional chess.

This improved chess game, however, has departed in significant ways from a traditional chess game. It is those areas of marked departure from conventional chess that make this invention so significant. For example, several pieces, such as a pair of gunboats for each side, have particularly unique moves that do not have any correspondence in conventional chess. Additionally, the new chess board has a restricted zone located at the interior of the board, and gunboats "boarded" or "un-boarded" may not enter into that restricted zone.

A ten row and ten column checkered matrix forms the invention's board, and the interior-most thirty-six squares are encircled by a red line to form and designate the restricted zone that is excluded from gunboat entry. A gunboat may, however, capture pieces within this restricted zone by its "long range guns" which will capture a piece that sits on any square three squares in any straight-line direction away from that occupied by the gunboat itself. The gunboat also captures pieces with its "guns" in the same manner in the non-restricted board area.

The invention further provides a playing board that has a center line of a distinctive color, such as gold, across the center of the boarding circles, as shown in FIG. 1, or across the entire checkered matrix (not shown). This center line is an aid in properly orienting the board for play. Additionally a "Boarding Circle", also distinctively colored, is provided on the board, with one circle for each player. The boarding circles are outside the checkered matrix and are located adjacent to the gold center line with one circle on each side of the board. The circle, which may also be gold colored, is used as a resting place for the piece that has "boarded" the gunboat until the boarded piece disembarks and again enters alone onto a square in the playing field. Each player uses the circle on his right as he is playing.

Any piece may board a gunboat and the boarding move is indicated by planting a pennant on the gunboat, and placing the "boarded" piece in the gold circle opposite the gold line outside the playing area. The moves and powers of the gunboat remain unaffected by having a passenger (but see boarding the President below.) Only one gunboat per player may have a passenger at any given time. If the gunboat is captured, the passenger is captured with it.

"Boarding the President." The President may also "board" one of his gunboats. A gunboat with the President aboard combines the moves of the gunboat and the President. That allows the gunboat to capture a piece on an adjacent square, like a President, while continuing to have all its normal powers enabling it to capture any piece three squares away. The gunboat, of course, must still move only within its permissible boundary zone. When carrying the President, the gunboat may not be captured but is subject to being checkmated. The rules of check and checkmate that apply to the President also now apply to the gunboat as long as the President remains aboard.

BRIEF DESCRIPTION OF THE DRAWING

FIG. 2 includes FIGS. 2A and 2B, wherein FIG. 3 includes FIGS. 3A and 3B, wherein

DESCRIPTION OF PREFERRED EXAMPLE EMBODIMENTS AND BEST MODE OF THE INVENTION

The invention is a game of tactics and strategy and includes an article of manufacture and a method. The game of the invention is played on a special ten-square by ten-square checkered board of 100 alternately colored gray and blue squares, with twenty pieces per set of playing pieces shaped to resemble figures from both sides of the American Civil War. Twenty Civil War playing pieces are allotted to each opposing player and these playing pieces are moved in a manner resembling traditional chess. The invention, however, has more playing pieces, a larger board (including a restricted zone) and provides novel rules stipulating both movement and capture strategy that have no parallel in conventional chess.

While many of the pieces in each opposing player's set have conventional chess-type playing moves and capture strategy, some of the pieces, such as a gunboat on each side, are truly non-conventional. The gunboats, for example, have particularly unique moves and capture strategy.

A pair of gunboats, configured as the Monitor or the Merrimac, is provided for each player. In accordance with the invention, a gunboat may not enter a thirty-six square restricted zone which is located in the center of the playing board. The gunboat does, however, have flexibility in moves and capturing ability as it permissively moves around a two-square border formed outside the restricted zone. Gunboats, although prohibited from entering the restricted zone, may capture pieces both within and without this restricted zone.

In order to more fully describe the invention, reference will now be made to the drawings of the invention.

Figure 1:
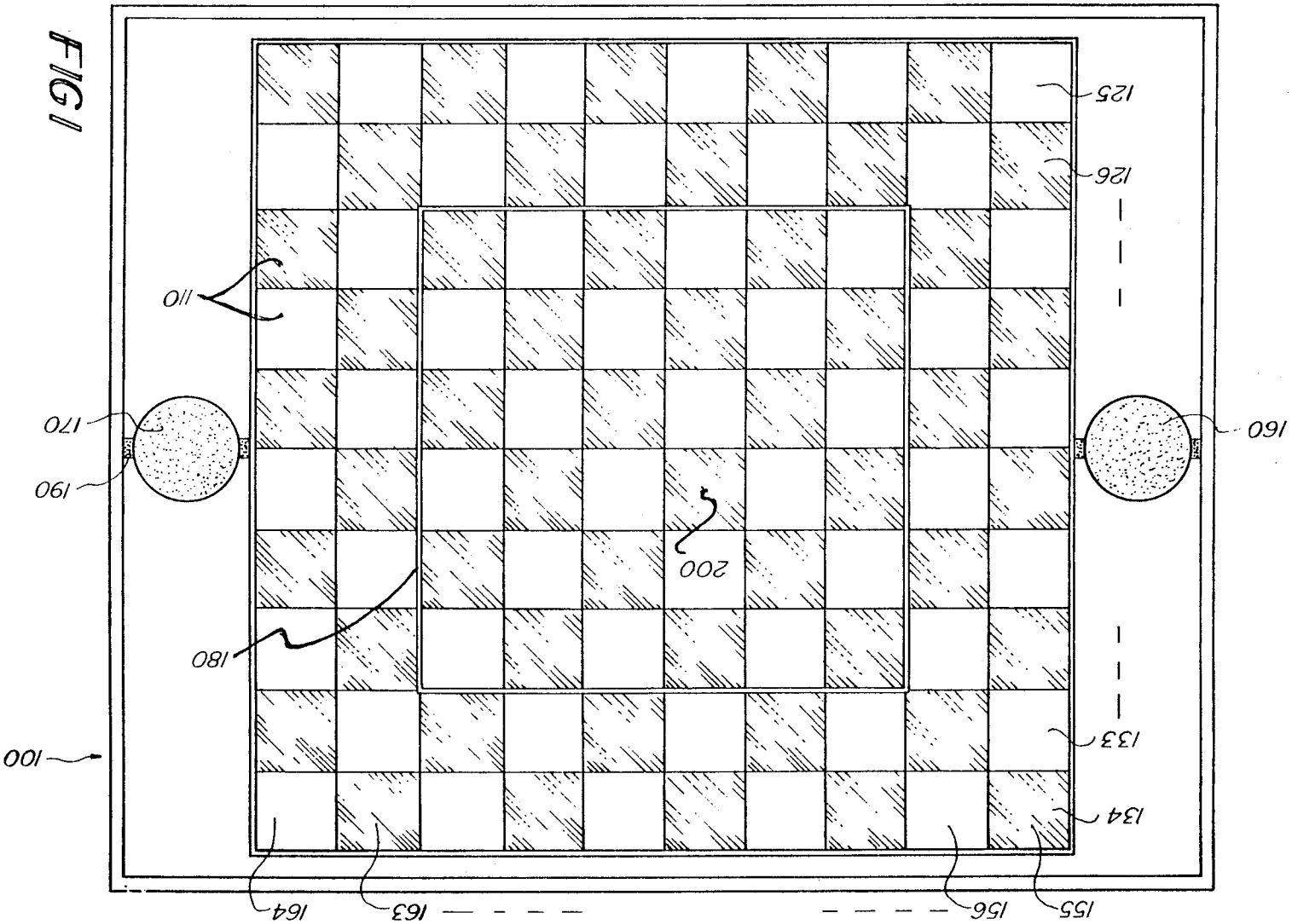
FIG. 1 is a plan view of a playing board in accordance with the invention.
Figure 3B:
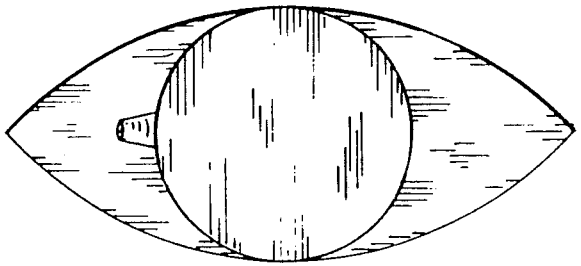
FIG. 3B is a top view of the Monitor playing piece in accordance with the invention.
Figure 3A:
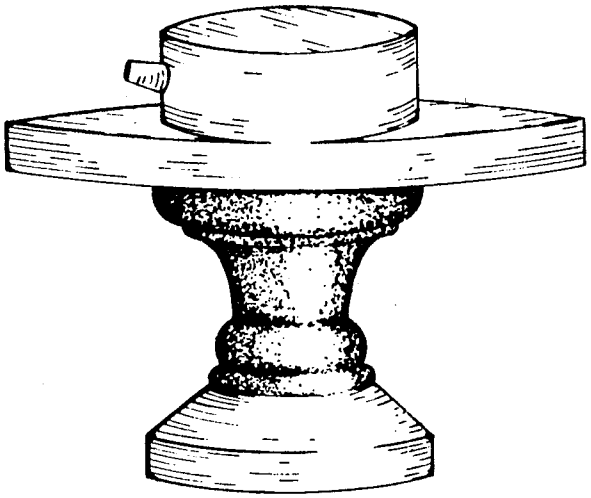
FIG. 3A is a side view of a gunboat playing piece configured as the Monitor.
Figure 2B:
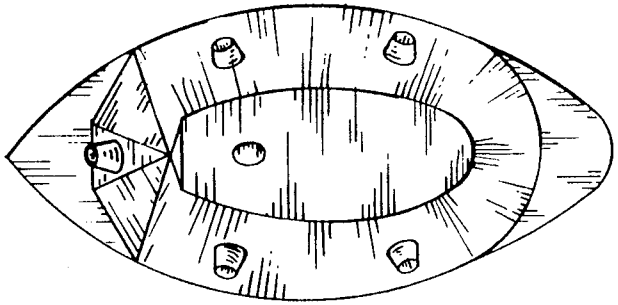
FIG. 2B is a top view of the Merrimac playing piece in accordance with the invention.
Figure 2A:
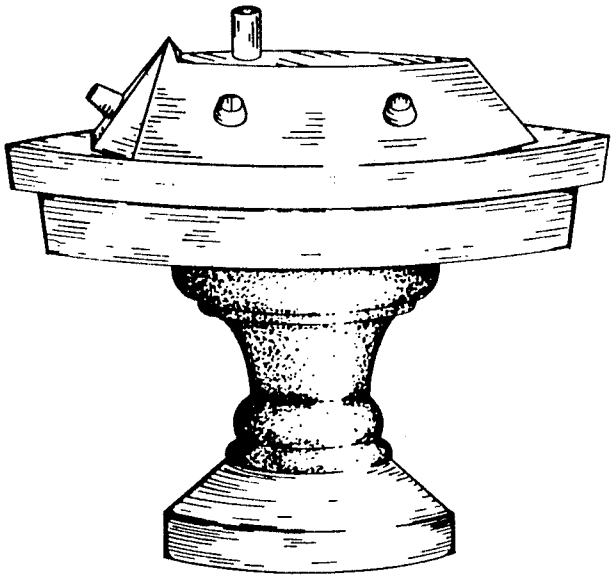
FIG. 2A is a side view of a gunboat playing piece configured as the Merrimac.

A. THE BOARD (Please see FIG. 1.)

The Civil War Chessboard 100 of this invention is a square divided into a total of one hundred checkered squares 110. Board 100 thus includes ten squares 110 on each side and ten squares in each direction across the board. This configuration provides ten ranks or rows 125–134 (those running from left to right of the player) of ten squares each and ten files or columns 155 through 164 (those running perpendicular to the bottom or near edge of the board) of ten squares each. The squares 110 are colored alternately blue and gray, beginning with gray in the lower left corner, to form a uniform checkered gray-blue pattern.

A red line 180 encloses the interior thirty-six squares and forms a restricted zone 200. The restricted zone is placed along the inside edges of the squares in the second ranks, and the second and ninth files or columns. This outlined area forms a restricted zone for the gunboat pieces, as will be explained in more detail hereinafter.

A heavy gold line 190 is drawn as an indicator of the middle of the board. Line 190 is simply is a line of demarcation between the Confederate territory and the Union territory, and is there mainly as an aid for orientation of the players and for dividing the squares for purposes of identification. It will also insure that the board 100 is turned in the correct way for the deployment of men and pieces for the start of the game, that is, with a gray square at each player's lower left corner.

Boarding circles 160 and 170, outside the checkered matrix, are located adjacent to the gold center line 190 with one circle on each side of the board. Each circle is used as a resting place for a piece that has "boarded" the gunboat until the boarded piece disembarks and again enters alone onto the playing field.

In order to explain the disposition of men and pieces and to explain moves to other parties, the squares on the board are identified by coordinates. The files are are assigned an identifier as to location across the bottom of the board, left to right, from 1 to 10. The ranks are are also assigned an identifier as to location along the left outside margin, from 1 to 5. This is done from each direction on the one half of the board adjacent to the player.

The one-half board on which the gray men and pieces are initially deployed, is the "Confederate" side. The other half, where the blue men and pieces are initially deployed, is the "Union" side.

In reading or expressing the coordinates for a given square, one must always "read right up." That is, first give the number of the file, and then the number of the rank. For example, the gray square at the farthest out rank on the Confederate side, and second in from the right margin would be identified as "Confederate 9-5" (C 9-5). If the player on the Union side were to move one of his men to the square directly confronting one on that square, he would be moving to "Union 2-5" (U 2-5).

B. THE MEN AND THE PIECES

Men and pieces are colored blue for the Union side and gray for the Confederate side.

Each side has ten infantry, referred to as "men"—each a figure of a soldier with musket. These ten infantry men correspond to eight pawns per side in traditional chess. Additionally ten other "pieces" per side are provided as follows:

One president (a likeness of Jefferson Davis for the gray and of Abraham Lincoln for the blue), One general (a likeness of Robert E. Lee for the gray and of Ulysses S. Grant for the blue), Two flags (figures of a soldier carrying a Confederate battle flag for the gray and of a soldier carrying a U.S. flag for the blue), Two cavalry (figures of a solidier on a horse for each), Two cannon (figures of a siege gun for each), and Two gunboats (symbols of the rectangular, slanted iron clad "Virginia" or "Merrimac" for the gray and the round superstructure of the "Monitor" for the blue).

Table 1 below summarizes the correspondence/divergence of Civil War Chess in accordance with the invention as compared with traditional chess. Where there is an equivalence it is shown in Table 1.

TABLE 1

| TRADITIONAL | CIVIL WAR CHESS |
|---|---|
| King | President |
| Queen | General |
| Bishop | Flag |
| Knight | Cavalry |
| Castle | Artillery |
| Pawn (8/side) | Infantry (10/side) |
| None | Gunboats (2/side) |

C. DEPLOYMENT

For the start of a game, the ten infantry are deployed across the second rank or row of each player, one man on each square. The general always stands on his own color. Thus the gray general stands on square Confederate 5-1, and the blue general on Union 6-1. The president on each side stands beside the general, the gray on 6-1, the blue on 5-1. Next come the two flags, one beside the general and one beside the president, on squares 4-1 and 7-1 (the same for both sides, Confederate and Union). Then, continuing outward, next come the two cavalry on squares 3-1 and 8-1 for each side. Next are the two cannon on squres 2-1 and 9-1 for each side. Finally, the two gunboats are on squares 1-1 and 10-1 for each side.

In summary, going all the way across the board, in the nearest row to the player, the pieces are in the following order from left to right on the Confederate side: gunboat, cannon, cavalry, flag, general, president, flag, cavalry, cannon, gunboat. On the Union side they are in the following order, left to right: gunboat, cannon, cavalry, flag, president, general, flag, cavalry, cannon, gunboat.

D. MOVES AND POWERS

Players familiar with the traditional game of chess will recognize that the infantry has the moves of the traditional pawn; the president has the moves of the traditional king; the general, the moves of the traditional queen; the flag, the moves of the traditional Bishop; the cavalry, the moves of the traditional knight, and the cannon, the moves of the traditional castle or rook. These traditional moves are equivalent for the invention as well.

Each infantry may move straight forward, one square at a time, except on its first move, at the discretion of the player, it may move forward two squares. After the first move, whether or not he took the privilege of moving two squares on his first move, he may advance only one square. However, an infantry can capture only diagonally—one square to the right oblique or left oblique. An infantry can never move backwards. It may advance only to an unoccupied square. If it captures an opposing man or piece by a diagonal move, that man or piece is taken from the board and the capturing infantry occupies the square thus vacated. If it happens that an infantry moves into the opposing territory, and an opposing infantry under the option of moving two squares on its first move thereby passes the incoming infantry, the latter, at the option of the player, may capture that infantry by moving diagonally onto the square that it has crossed over.

The president may move only one square at a time, but may move in any direction to an unoccupied square, or in capturing an opposing man or piece, so long as such a move does not put the president into "check," that is, in a position to be captured by any opposing man or piece.

The general moves in any direction in a straight line—forward, backward, diagonally, or laterally. There is no limit to his range over vacant squares. He may capture an opponent and move to the square vacated by the captured opponent. A man or piece of his own color stops him.

The flags move diagonally in any direction, thus always remaining on the same color of square. They, too, have unlimited range, with the same conditions as those noted for the general.

The moves of the cannon are similar to those of the flag except that they must be straight forward or backward along a single file, or laterally along a rank to the right or left, always in a straight line with the same unlimited range, blocking, and opportunities for capture that apply to the general and the flags.

(The general, it will be seen, combines the moves of the flag and those of the cannon.)

The moves of the cavalry are of a different order. The cavalry moves from one corner of any rectangle formed (from where it stands) of any three squares by two squares, to the opposite corner. To put it another way, the cavalry may move (1) straight forward two squares and to the right or left one square, or (2) straight backward two squares and one square to the right or left, or (3) straight to the left two squares and forward or backward one square, or (4) it may move straight to the right two squares and forward or back one square. That is to say, a cavalry in one move passes over two squares in one direction and then occupies one square at right angles in either direction. This may be done so long as no man or piece of the same color occupies the square of destination. Any men or pieces occupying the intervening squares can be jumped over. If an opponent man or piece occupies the square of destination, it is captured. It will be noted that a cavalry always moves to a square of a different color.

The gunboat too has moves and powers of an altogether different order. It may move forward or backward or laterally or diagonally in any direction, as far as desired, so long as it passes only over vacant squares in a straight line and with the critical proviso that it cannot enter the "restricted zone" 200 as defined by the red line 180, FIG. 1, on the playing board 100. This means that a gunboat can move only along the squares that comprise the outer two ranks and files, all the way around the board 100.

Each gunboat is provided with long ranges guns. Within its permissible border area, the gunboat moves like a general. But it captures opposing men and pieces in a different way. It makes a capture by bringing opposing men and pieces within range of its "long-range guns," that is, on the third square, in a straight line in any direction, forward, backward, laterally, or diagonally from the square on which the gunboat sits. The act of capture itself constitutes one move and one turn of the player. Opponents at closer range, on the first or second square away, are not liable to capture. When the gunboat comes within range of an opponent, the player may choose to make the capture or not on his next turn if the opponent remains there. If two or more opponents come within range at the same time, only one may be captured on each move, that is with each turn of the player.

If men or pieces, whether of the same or differing color, occupy squares between the gunboat and an opponent on a third square away, they pose no obstacle; the act of capturing simply passes over them. In making a capture a gunboat does not move from the square that it occupies. The player simply announces that he is making a capture and removes the vulnerable opponent from the board. The square upon which the captive stood remains vacant until some other man or piece moves onto it. The gunboat itself is subject to capture in the same way as any other piece.

Another unique feature of the invention also involves a gunboat. This feature is a new move referred to as "boarding". Any player's own piece may "board" one of that player's own gunboats. Such boarding may be accomplished whenever a gunboat approaches to the adjacent square in any direction from the piece that is to be boarded. The act of boarding constitutes one move, and the "boarding" itself is indicated by planting a pennant on the gunboat, and placing the "boarded" piece in that player's gold boarding circle (160 or 170) opposite the gold line 100. A boarded passenger may disembark onto any unoccupied square adjacent to the gunboat. Disembarking constitutes one move.

The moves and powers of a boarded gunboat remain unaffected by having a passenger (but see boarding the President as described below.) Only one gunboat per player may have a passenger at any given time. If the gunboat is captured, the passenger is captured with it.

"Boarding the President." The President may also "board" one of his gunboats. This may be accomplished whenever a gunboat is on an adjacent square in any direction from the President. The act of boarding will constitute one move, and is indicated by planting a pennant on the gunboat, and placing the President in the player's gold boarding circle.

A gunboat with the president aboard combines the moves of the gunboat and the president. That allows the boarded gunboat to capture a piece on an adjacent square, like a President, while continuing to have all its normal powers enabling it to capture any piece three squares away. The gunboat must still, of course, move only within its permissible border zone and may not enter the restricted zone 200.

The President may disembark, onto an unoccupied and non-threatened square adjacent to the gunboat. Such disembarking also constitutes one move. When carrying the president, the gunboat may not be captured but is subject to being checkmated. The rules of check and checkmate that apply to the President likewise apply to the gunboat as long as the president remains aboard.

E. RULES OF ENGAGEMENT

Before the beginning of play, the two players may agree on which is to take blue and which gray and operate respectively from the Union side or the Confederate side of the board. Or one player may take a piece of one color in one hand and a piece of the other color in the other hand, and then let the other player point to one of those hands and take whichever color it happens to be holding.

Gray always makes the first move. Thereafter each player in turn moves a man or piece. As noted, an infantry may capture any man or piece that is on a square immediately to the right front or left front diagonal (or in case of being passed by an opposing infantry that is advancing two squares on its first move, by moving to the square crossed over). The president, general, flags, cavalry, and cannon may capture any opponent that occupies any square to which it is entitled to move by its prescribed moves. The un-boarded gunboats may capture any opponent that occupies the third square away in any direction.

A move is completed when a player, having moved a man or piece to another square, removes his hand from the man or piece. Thereafter it cannot be retrieved or touched again until another turn. However, if a player wants to correct the position of a man or piece so that it will stand properly on the square, he may announce "adjust," and correct the position of the man or piece on the square without involving the use of a turn.

If an infantry moves all the way across the board to the opponent's rank 1, it must be exchanged for a piece, chosen by the player, that has been already captured. In the event that no piece has been captured, the infantry remains immobile on that square until a piece is captured (or until it is captured). In that case, a player may choose to sacrifice one of his powerful pieces in order to get it automatically to an advantageous position on the opponent's president's row.

Under certain conditions, the president and one of the cannons may execute an "unlimbering" (as "castling" in traditional chess). If no men or pieces stand between the president and a cannon, and neither has been moved previously, and no opposing man or piece commands one of the intervening squares, and provided the president is not in check, the president may be moved two squares laterally toward the cannon, and then the cannon is placed next to him on the other side.

If a player touches one of his men or pieces, he must move it (unless he has said that he is adjusting and touches the man or piece only to set it right on its square). If the player is unable to move the touched piece legally, he must move his president if he can (but may not do an unlimbering movement). If the president cannot be moved (either because adjacent squares are occupied by men or pieces of the same color or he would be moving into check), there is no penalty.

If a player touches an opponent's man or piece, he must take it if that is possible. If not, he must move his president. If neither is possible, there is no penalty.

When a man or piece comes into a position to threaten directly the capture of the president, the president is said to be "in check," and this must be announced. A president may not be moved into check. One president cannot check the other president. An infantry puts a president in check in the same way that he threatens the capture of any other piece, on the diagonal at one square away. The gunboat gives check by moving to any square that is the third square away from the president in any direction.

The president never can be actually captured, but when he is brought into check by any opposing man or piece, he must move from the square that he occupies (either to a vacant square or by capturing an opponent on an adjacent square), or be screened from check by the interposition of one of his own men or pieces (to effect a screen a gunboat would have to move physically between the president and his attacker), or the attacking piece must be captured by one of the president's men or pieces.

F. ENDING THE GAME

If the president is brought into check and none of his men or pieces can come to his rescue, and he cannot move to any other square either because it is occupied by one of his own men or pieces, or because he would be moving into check, it is "checkmate." That situation ends the game, and the player whose president has been checkmated is the loser.

If the president is not in check, but his owner has no move left other than one that would place the president in check, it is "stalemate," and the game is a draw.

If a situation occurs where a president can only move out of check and then immediately be put back into check, repeatedly and indefinitely, that is "perpetual check," and in that case, too, the game is a draw.

If neither player has sufficient force left to effect a checkmate, this also may be a drawn game.

Finally, one player may challenge the other to effect a checkmate in fifty moves. If the opponent fails to do this, then that is a drawn game.

A sequence of two out of three or three out of five games may be agreed upon by the players to determine a winner. Then the colors, with the right to make the first opening move, should be alternated. (Or the players may prefer to keep the same colors but alternate the right to make the first move.)

While the invention has been described with reference to a particular example of preferred embodiments, it is the intention to cover all modifications and equivalents within the scope of the following claims. It is therefore requested that the following claims which define the invention be given a liberal interpretation within the spirit and scope of the inventor's contribution to this art.

What is claimed is:

1. A method of playing a board game of logic and strategy comparable to chess in that it is played by opposing players on opposite sides of a checkered board with playing pieces that are moved by the players in accordance with prescribed rules for both movement and capture in order to try to place the opponent in a condition of checkmate, said method comprising the steps of:

covering a playing board with a checkered surface formed by ten alternating-colored and equal sized squares in a ten-square row and ten-square column matrix that yields a total of at least one hundred squares over the surface of the playing board;

establishing at the center of said playing board a restricted zone formed from a multiplicity of squares which are equally divided for each player on his side of the playing board;

formatting predetermined rules of movement for play wherein a particular type of playing piece for each player may not move into that restricted zone; and additionally formatting a rule of capture for play wherein said particular piece is permitted capture of an opponent's pieces within and without the restricted zone, which particular type of pieces themselves are excluded from movement by the players into the restricted zone.

2. A method in accordance with claim 1 and further comprising the step of:

formatting said restricted zone to include at least thirty-six squares centered in said playing surface.

3. A method in accordance with claim 2 and further characterized by the additional steps of:

centering said restricted thirty-six square zone in the middle of said playing surface in order to provide at least a two-square border around said restricted zone; and defining a rule of movement for play wherein said particular piece for each player may only be moved in said border area in accordance with predetermined movement rules for said game.

4. A method in accordance with claim 3 and further comprising the step of:

additionally defining a rule of movement for said particular type of piece within said border which allows said type of piece to be moved forwardly, backwardly, laterally, or diagonally in any straight-line direction as far as desired so long as it only passes in a straight line over vacant squares.

5. A method in accordance with claim 1 wherein traditional chess has thirty-two playing pieces, sixteen per set for each player, and said method is further characterized by the additional steps of:

allocating a total number of at least forty playing pieces for said game; and dividing said forty playing pieces equally into two identical sets of twenty playing pieces per player, with each player having a different color set of playing pieces.

6. A method in accordance with claim 1 wherein traditional chess has thirty-two playing pieces, sixteen per set for each player, and said method is further characterized by the additional steps of:

allocating a total number of forty playing pieces divided equally into two identical sets of twenty per player, with each player having a set of different color; and likening the figures of each set so as to resemble the figures of the American Civil War.

7. A method in accordance with claim 6 wherein said likening step is further characterized by the additional steps of:

designating each set of playing pieces to include ten infantry, one president, one general, two flags, two calvary, two cannon, and two gunboats.

8. A method in accordance with claim 6 wherein said likening step for the president is further characterized by the additional step of:

representing one president in the likeness of Jefferson Davis for the gray and in the likeness of Abraham Lincoln for the blue.

9. A method in accordance with claim 6 wherein said likening step for the general is further characterized by the additional step of:

representing one general as a likeness of Robert E. Lee for the gray and in the likeness of Ulysses S. Grant for the blue.

10. A method in accordance with claim 6 wherein said likening step for the flag is further characterized by the additional step of:

representing one flag in the likeness of a Confederate battle flag for the gray and a Union battle flag for the blue.

11. A method in accordance with claim 6 wherein said likening step for the gunboat is further characterized by the additional step of:

representing gunboats in a likeness of the Merrimac, for the gray and in a likeness of the round superstructure of the Monitor for the blue.

12. An improved method of playing chess by opposing players on opposite sides of a checkered board with playing pieces that are moved by the players in accordance with prescribed rules for both movement and capture in order to try to place the opponent in a condition of checkmate, said improved method comprising the steps of:

covering a playing board with a checkered surface formed by ten alternating-colored and equal sized squares in a ten-square row and ten-square column matrix that yields a total of one hundred squares over the surface of the playing board;

allotting each player a set of twenty playing pieces in which sixteen of the twenty are played in direct equivalence with traditional chess, but two playing pieces per set are uniquely different in that these two do not have any correspondence to any playing piece in a traditional chess game;

establishing at the center of said playing board a restricted zone formed from a multiplicity of squares;

formatting predetermined rules of movement for play wherein the two unique playing pieces per player may not move into that restricted zone; and additionally formatting a rule of capture for play wherein said two unique pieces are permitted capture of an opponent's pieces within and without the restricted zone, while the two themselves are excluded from movement into the restricted zone.

13. An improved method of playing chess comprising the steps of:

providing an enlarged playing board with a checkered surface formed by ten alternating-colored squares in a ten-square row and a ten-square column matrix that yields a total of one hundred squares for the playing surface on the board;

allotting twenty playing pieces per player rather than sixteen as in traditional chess with the improved chess having ten pawn types rather than eight as in traditional chess and additionally having two unique pieces per set which have no correspondence to traditional chess;

establishing a restricted zone on the playing surface;

prohibiting movement of said two unique playing pieces per player from that restricted zone but allowing movement around the restricted zone; and permitting capture of an opponent's pieces within the restricted zone even though the capturing piece remains outside that restricted zone.

14. A method in accordance with claim 13 wherein the two unique playing pieces are denominated as gunboats having long range guns, and said method further comprises the additional step of:

defining a rule of movement for said gunboat piece(s) within said border which allows said type of piece to be moved forwardly, backwardly, laterally, or diagonally in any straight-line direction as far as desired so long as it only passes in a straight line over vacant squares; and from within its permissible border area, the gunboat captures opposing pieces by bringing opposing pieces within range of its long-range guns, that is, on the third square, in a straight line in any direction, forward, backward, laterally, or diagonally from the square on which the gunboat sits.

15. A method in accordance with claim 14 and including a new move referred to as "boarding", said method being further characterized by:

any player's own piece may board that player's own gunboats whenever a gunboat approaches to the adjacent square in any direction from the piece that is to be boarded:

boarding constitutes one move, and the boarding itself is indicated by planting a pennant on the gunboat, and placing the boarded piece in that player's boarding space, which space is located outside the checkered playing surface.

16. A method in accordance with claim 15 and including a move referred to as boarding the president, said method being further characterized by the additional steps of:

allowing the President to board one of his gunboats whenever a gunboat is on an adjacent square in any direction from the President.; and allowing a gunboat with the president aboard to move in a pattern of movement which combines the moves of the gunboat and the president.

17. A method in accordance with claim 16 and said method being further characterized by the additional steps of:

allowing the boarded gunboat to capture a piece on an adjacent square, like a President, while continuing to have all its normal powers enabling it to capture any piece three squares away.

18. A method in accordance with claim 17 and including a new move referred to as boarding the president, said method being further characterized by the additional steps of:

allowing the boarded gunboat to move only within its permissible boarder zone and not enter the restricted zone; and when said gunboat is carrying the president, the gunboat may not be captured but is subject to being checkmated by the rules of check and checkmate that likewise apply to the President as if not boarded.

* * * * *